United States Patent [19]

Feuchter

[11] Patent Number: 4,785,620

[45] Date of Patent: Nov. 22, 1988

[54] BEARING AND DRIVE FOR A SPINNING ROTOR

[75] Inventor: Wolfgang Feuchter, Deggingen-Reichenbach, Fed. Rep. of Germany

[73] Assignees: Fritz Stahlecker; Hans Stahlecker, both of Fed. Rep. of Germany

[21] Appl. No.: 162,688

[22] Filed: Mar. 1, 1988

[30] Foreign Application Priority Data

Mar. 24, 1987 [DE] Fed. Rep. of Germany ..... 3709576

[51] Int. Cl.[4] ..... D01H 1/241; D01H 1/135; D01H 7/885; D01H 7/22

[52] U.S. Cl. ..... 57/406; 57/88; 57/92; 57/105; 57/301

[58] Field of Search ..... 57/88, 89, 92, 104, 57/105, 78, 406, 407, 300–302, 306

[56] References Cited

U.S. PATENT DOCUMENTS

| | | | |
|---|---|---|---|
| 3,805,506 | 4/1974 | Stahlecker | 57/78 |
| 3,868,815 | 3/1975 | Stahlecker | 57/105 X |
| 3,999,365 | 12/1976 | Suzuki | 57/88 |
| 4,112,659 | 9/1978 | Stahlecker et al. | 57/88 X |
| 4,265,083 | 5/1981 | Braun et al. | 57/302 X |
| 4,402,177 | 9/1983 | Grimm et al. | 57/104 X |
| 4,574,577 | 3/1986 | Derichs et al. | 57/406 X |
| 4,703,616 | 11/1987 | Feuchter et al. | 57/406 X |
| 4,706,450 | 11/1987 | Feuchter et al. | 57/88 |

*Primary Examiner*—John Petrakes

*Attorney, Agent, or Firm*—Barnes & Thornburg

[57] ABSTRACT

A bearing and driving unit for a spinning rotor of an open-end spinning unit is provided. A braking element is provided for braking a rotor shaft, and a cleaning element is provided for cleaning the rotor shaft. Actuating elements are provided for activating and deactivating the braking element and the cleaning element. The cleaning element is applied to the rotor shaft with a contact force which is controlled independent of a contact force control of the braking element.

17 Claims, 1 Drawing Sheet

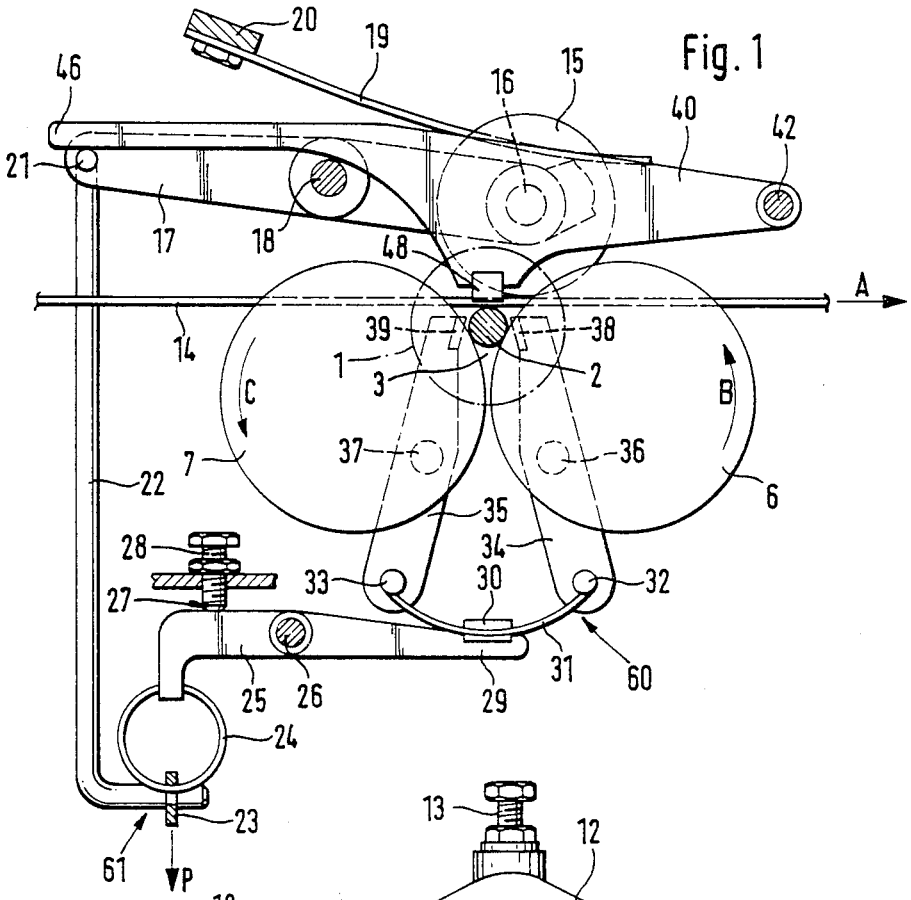
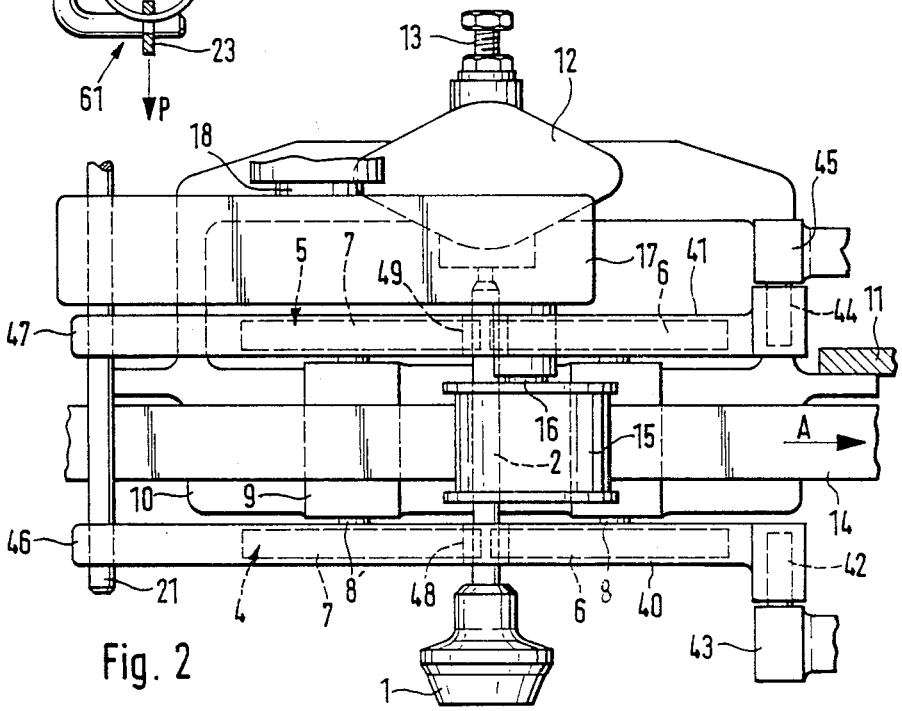
Fig. 2

BEARING AND DRIVE FOR A SPINNING ROTOR

BACKGROUND AND SUMMARY OF THE INVENTION

The invention relates to a bearing and a drive for a spinning rotor unit that has a horizontally arranged shaft to which a rotor is attached, a brake for braking the rotor and cleaning elements that can be applied to the shaft.

Particularly during the processing of synthetic fibers, the so-called supporting disk bearings for open-end spinning rotors, that are used in practice in large numbers, it was found that the smallest fiber components, dust or other deposits will arrive on the shaft and will then be pressed into the running surfaces of the supporting disks. This may result in the shaft no longer rolling uniformly at the supporting disks so that the whole spinning rotor runs erratically.

It has been suggested in German Patent Application No. P 36 30 256.2 (no prior publication) to assign cleaning elements in the form of holding-down jaws to the shaft, in the area of the wedge-shaped gaps. When the brake of the spinning rotor is actuated, these jaws are applied to the shaft. In this construction, a brake is provided that contains a brake block that can be applied to the shaft from the side that faces away from the tangential belt. The holding-down jaws that are used as cleaning elements are arranged on the side of the tangential belt and are applied to the rotor shaft at the same time as the brake lining. So that the shaft remains securely in the wedge-shaped gap during braking, it is provided that the force that is applied by the holding-down jaws is larger than the force applied by the brake. Although an effective cleaning of the rotor shaft can be achieved in the area of the running surfaces of the pairs of supporting disks using this construction, forces affect the shaft of the spinning rotor that are quite high. Also, even if the coefficient of friction of the holding-down jaws is reduced as low as possible, the danger still exists that furrows or the like are cut into the shaft by the holding-down jaws. Furrows of this type, in turn, may result in an untrue run of the shaft and thus an untrue run of the spinning rotor.

An object of the present invention is to provide a bearing and a drive assembly such that the spinning rotor shaft is cleaned when the rotor brake is actuated, such that the forces that are applied for the cleaning are not dependent on the actuating force required to brake the rotor shaft.

This object is achieved by providing braking elements and cleaning elements which are applied to a rotor shaft with a controlled contact force. Actuating elements are provided for activating and deactivating the braking elements and the cleaning elements. The cleaning elements contact force control is independent of the braking elements contact force control.

Although the present invention ensures that the cleaning elements are actuated simultaneously with the brake, the application operation of the cleaning elements and of the brake are completely separate from one another, particularly with respect to the forces that affect the shaft. As a result, it is possible to proportion the cleaning forces such that, on the one hand, an effective cleaning is achieved, while, on the other hand, the shaft is not damaged.

According to other advantageous features of certain preferred embodiments of the invention, it is provided that the cleaning elements are movably held such that gravitational force is used as the application force. As a result, it is possible to proportion the cleaning forces via the dead weight of the cleaning elements and their holding elements.

According to other advantageous features of certain preferred embodiments of the invention, it is provided that the cleaning elements are mounted at swivel arms that can be swivelled around a stationary axis that is essentially parallel to the shaft of the spinning rotor. Because the cleaning elements act into the wedge-shaped gaps in these embodiments, no problems occur with respect to a time sequence.

According to other advantageous features of certain preferred embodiments of the invention, it is provided that the actuating elements of the brake contain support devices for holding elements of the cleaning elements that, when the brake is actuated, can be moved out of the path of motion of the holding elements of the cleaning elements that is directed toward the shaft. As a result, it is achieved in a simple way that, when the brake is actuated, the application of the cleaning elements is released on the basis of a dead weight or, if necessary, it is contemplated to use additional forces that are controlled by means of spring elements, while, on the other hand, when the brake is released, the cleaning elements are lifted off the shaft.

According to other advantageous features of certain preferred embodiments of the invention, it is provided that the actuating elements of the brake are coupled with elements for lifting off a pressure roller which is applied to the tangential belt during the driving of the shaft. The lifting off elements are in turn coupled with holding elements of the cleaning elements. As a result, a favorable utilization of space is made possible because the pressure roller and the holding elements for the cleaning elements are arranged on the same side with respect to the tangential belt. Thus, it is contemplated to implement constructionally advantageous solutions. Further, it is also advantageous that the cleaning elements can be actuated with the holding elements in opposite direction of the pressure roller.

Other objects, advantages and novel features of the present invention will become apparent from the following detailed description of the invention when considered in conjunction with the accompanying drawings.

BRIEF DESCRIPTION OF THE DRAWINGS

FIG. 1 is a Partial cross-sectional view of a bearing and a drive in the direction of the shaft of a spinning rotor, in which for the purpose of outlining, the shaft and the stationary axes that are parallel to it are provided with a hatching and some elements are only outlined by interrupted lines; and FIG. 2 is a top view of the drive and the bearing according to FIG. 1.

DETAILED DESCRIPTION OF THE DRAWINGS

The open-end spinning rotor 1 that is shown in FIGS. 1 and 2 is provided with a horizontally aligned shaft 2 that is disposed radially in the wedge-shaped gaps 3 of pairs 4 and 5 of supporting disks. Each pair 4, 5 of supporting disks is formed by two supporting disks 6, 7 that are equipped with a ring mounting on their circumference which is made of a plastic material that is not shown. The supporting disks 6, 7 are driven in the direction of the arrows B and C via the shaft 2. The shaft 2, in turn, is driven by a tangential belt 14 moving in the direction of the arrow A. In certain preferred practical embodiments, the tangential belt 14 is used for driving all spinning units arranged on one side of the machine.

The supporting disks 7 on one side of the shaft 2 are both arranged on a joint shaft 8'. Similarly, the supporting disks 6 on the other side of the shaft 2 are both arranged on a joint shaft 8. The shafts 8, 8' are each disposed in a bearing housing 9 by means of roller bearings. The bearing housings 9 are housed in a bearing block 10 that is fastened at the machine frame of the op®n-end spinning machine in a way that is not shown in detail. FIG. 2 shows a part of a support 11 of the machine frame.

On the side of the bearing block 10 that faces away from the spinning rotor 1, a step bearing 12 is arranged in which the end of the shaft 2 is supported in axial direction. The position of the support can be adjusted via an adjusting screw 13 in axial direction of the shaft 2. The shafts 8, 8' of the supporting disks 6, 7 are slightly offset with respect to an axis that extends in parallel to the tangential belt 14 so that a axial push is exercised on the shaft 2 by means of which the shaft 2 is pressed into the step bearing 12.

The tangential belt 14 that moves against the shaft 2 and thus holds the shaft 2 in the wedge-shaped gaps 3 of the pairs 4, 5 of supporting disks is loaded by means of a pressure roller 15 in the immediate vicinity of the shaft 2. The pressure roller 15 exercises a loading force on the tangential belt 14 that acts into the wedge-shaped gap 3. The pressure roller 15 is freely pivotable around a shaft 16 of a two-armed lever 17 that can be swivelled around a shaft 18 that is essentially parallel to the shaft 2. The lever 17 is loaded by a leaf spring 19, the end of which that faces away from the lever 17 is fixed at a stationary component 20.

A brake 60 is assigned to the shaft 2 of the spinning rotor 1, and is actuated by control devices that are not shown, particularly for eliminating a yarn breakage. The brake 60 includes two levers 34, 35 arranged in a Plier-type arrangement. The two levers 34, 35 can be swivelled around stationary shafts 36, 37 that are essentially parallel to the shaft 2. The ends of the levers 34, 35 that face the shaft 2 are equipped with brake linings 38, 39 that can be applied to the shaft 2 from the sides of the shaft in the area below the tangential belt 14. In this case, the levers 34, 35 are designed such that the brake linings 38, 39 clamp the shaft 2 between one another such that, in the process, the shaft is loaded with one force component in the direction into the wedge-shaped gap 3.

An actuating member 31 is constructed as a bow-shaped leaf spring. At pivotal points 32, 33, the actuating member 31 is pivotally connected to the ends of the levers 34, 35 that face away from the brake linings 38, 39. An arm 29 of a lever is provided which can be swivelled around a shaft 26 that is essentially parallel to the shaft 2. The arm 29 of the lever is arranged at the actuating member 31 via a driving device 30. Another arm 25 of the lever is connected with an actuating lever 23 via a transmission member 24 that is constructed as a ring-shaped spring element. The actuating lever 23 can be moved in the direction of the arrow P, whereby the two-armed lever 25, 29 is swivelled around the shaft 26 such that the arm 29 is moved into the area between the two arms 34, 35 so that these arms are moved in opposite direction with respect to one another. A stop 27 in the form of an adjusting screw 28 is assigned to arm 25 of the two-armed lever 25, 29 and limits the movement of the brake 60 during the return of the brake to the inactive position.

Elements are also inserted into the actuating devices 61 of the brake 60 by means of which the pressure roller 15 is moved away from the tangential belt 14 during the braking, such that the tangential belt 14 is lifted off the shaft 2 or is at least relieved from the load. A rod 22 is connected to the actuating lever 23 and is pivotally connected to the free arm of the lever 17. At this arm 17, another rod 21 is located that is essentially aligned with the shaft 18 and that, if necessary, is made in one part with the rod 22.

In order to clean the shaft 2 during the braking in the area that moves against the circumferential surfaces of the supporting disks 6, 7 that are formed by a mounting, cleaning elements 48, 49 are provided that are applied to the shaft 2 in this area when the brake 60 is actuated. These cleaning elements 48, 49 may include friction elements, brushes, or scrapers or blades or the like made of an elastic material. When the braking process is initiated, the cleaning elements 48, 49 are applied to the shaft 2 so that the shaft 2 is subjected to a cleaning effect while it is still rotating.

When the brake 60 is actuated, the cleaning elements 48, 49 are automatically applied to the shaft 2. When the brake 60 is released, the cleaning elements 48, 49 are lifted off the shaft 2. However, the forces which the cleaning elements 48, 49 act upon the shaft 2 are completely independent of the braking forces and the actuating forces of the brake 60. It is therefore Provided that the actuating devices 61 of the brake 60 operate as a sort of driving stop or detent by means of which the cleaning elements 48, 49 are held in the position in which they are lifted off the shaft 2. During the braking, the actuating means 61 are moved such that the rod (support or detent) 21 moves thereby releasing the application movement of the cleaning elements 48, 49 to the shaft 2. However, when the brake 60 is released, the rod 21 will be moved, thereby moving the cleaning elements 48, 49 into the original position in which they are lifted off the shaft 2.

In the shown embodiment, the cleaning devices 48, 49 are held by means of swivel arms (levers) 40, 41 that can be swivelled around stationary shafts 42, 44. The stationary shafts 42, 44 are mounted at stationary components 43, 45 and are aligned essentially in parallel to the shaft 2. The shafts 42, 44 are arranged such that the moving paths of the cleaning elements 48, 49 extend approximately tangentially with respect to the circumferential area of the supporting disks 6, 7 forming the wedge-shaped gap 3. Thus, the cleaning elements 48, 49 can be applied to the shaft 2 from above without any impairment.

The levers 40, 41 are extended to the rod 21 beyond the cleaning elements 48, 49 and their ends 46, 47 rest on the rod 21. In this case, the ends 46, 47 are constructed such that the levers 40, 41 hold the cleaning elements 48, 49 in the shown spinning operating position (FIG. 1) at a short distance from the shaft 2. As soon as the actuating devices 61 of the brake 60 are actuated, the rod 21 is also moved downward and the levers 40, 41 follow this downward movement because of their dead weight, and thereby apply the cleaning elements 48, 49 to the shaft 2. In certain preferred embodiments, a spring element similar to the pressure roller spring lever 17 can be used to force the cleaning elements 48, 49 toward the shaft when rod 21 is moved downward.

The point in time at which the cleaning elements 48, 49 reach the shaft 2, after the braking process is triggered, depends on the construction of the levers 40, 41 and on the relative arrangement of the cleaning elements 48, 49. The capability of providing adjustments is also contemplated. As a result, it is possible to prevent application of the cleaning elements 48, 49 to the shaft 2 before the shaft 2 is braked down to a rotational speed that is lower than the rotational spinning operating speed. This reduces the danger of damage to the shaft 2 and to the cleaning elements 48, 49 without impairing the cleaning effect.

Under certain circumstances, it may be sufficient to provide only one cleaning element 48, 49, particularly when the running surfaces of only one pair 4, 5 of supporting disks are endangered. This single pair 4, 5 will usually be the pair closest to the spinning rotor 1 so that only one cleaning element 48 is provided.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. Bearing and driving unit for a spinning rotor of an open-end spinning unit comprising:

at least one spinning rotor unit having a rotor and a rotor shaft attached to said rotor;

braking means for braking said rotor shaft when applied to said rotor shaft with a controlled contact force;

cleaning means for cleaning said rotor shaft when applied to said rotor shaft with a controlled contact force; and actuating means for activating and deactivating said braking means and said cleaning means to activated and deactivated positions, said cleaning means contact force control being independent of said braking means contact force control.

2. Unit as in claim 1, further including cleaning force control means for controlling the contact force of said cleaning means and braking force control means for controlling the contact force of said braking means.

3. Unit as in claim 2, wherein said cleaning force control means is controlled by gravity.

4. Unit as in claim 3, wherein said cleaning force control means include holding means for holding said cleaning means away from said rotor shaft in said deactivated position and for releasing said cleaning means, thereby allowing application of said cleaning means to said rotor shaft in said activated position.

5. Unit as in claim 4, wherein said holding means include at least one swivel arm on which said cleaning means are mounted and at least one stationary swivel shaft substantially Parallel to said rotor shaft about which said at least one swivel arm can pivot.

6. Unit as in claim 5, wherein said actuating means include supporting means for supporting said at least one swivel arm in said deactivated position of said cleaning means and for moving away from supporting said at least one swivel arm in said activated position of said cleaning means, thereby releasing said at least one swivel arm to pivot down onto said rotor shaft.

7. Unit as in claim 4, wherein said actuating means includes supporting means for supporting said holding means in said deactivated position of said cleaning means and for moving away from supporting said holding means in said activated position of said cleaning means.

8. Unit as in claim 7, wherein said actuating means are coupled to said braking force control means such that when said braking means are activated by said actuating means, said braking means are applied to said rotor shaft with the controlled contact force and said supporting means move away from supporting said holding means thereby permitting said cleaning means to be released into said activated position, and when said braking means are deactivated by said actuating means, said supporting means are moved back to support said holding means in said deactivated position.

9. Unit as in claim 8, further including a pivot shaft about which said holding means can pivot back and forth between said deactivated position and said activated position on said rotor shaft.

10. Unit as in claim 8, further including:

two pairs of supporting disks forming a wedge-shaped gap within which said rotor shaft is supported;

a tangential belt drivingly engageable with said rotor shaft at a side opposite said two pairs of supporting disks; and pressure roller means in proximity of said rotor shaft for applying loading forces against said tangential belt toward the wedge-shaped gap; and said actuating means further including means for lifting said pressure roller means away from applying loading forces against said tangential belt during the activating of said braking means and said cleaning means.

11. Unit as in claim 10, wherein during activation of said cleaning means, said cleaning means are moved toward said rotor shaft and said pressure roller means are moved away from said rotor shaft, and during deactivation of said cleaning means said cleaning means are moved away from said rotor shaft and said pressure roller means are moved toward said rotor shaft.

12. Unit as in claim 10, wherein said cleaning means are applied to said rotor shaft in the area of the wedge-shaped gaps in said activated position.

13. Unit as in claim 4, wherein said cleaning means contact force is less than braking means contact force.

14. Unit as in claim 4, wherein said holding means and said cleaning means include a given combined weight according to the cleaning means contact force desired.

15. Unit as in claim 2, wherein said cleaning force control means include spring means for controlling the contact force of said cleaning means.

16. Process for operating an open-end rotor spinning unit comprising:

driving a rotor shaft upon which is attached a rotor;

applying braking means to said rotor shaft with a controlled contact force during a braking operation;

applying cleaning means to said rotor shaft with a controlled contact force during a cleaning operation during said braking operation; and activating said braking means and said cleaning means such that the cleaning means contact force control is independent of the braking means contact force control.

17. Process as in claim 16, wherein said applying of said braking means to said rotor shaft precedes said applying of said cleaning means to said rotor shaft such that said driving of said rotor shaft is performed at a reduced speed during said cleaning operation.

* * * * *